US007445492B2

(12) United States Patent
Hiramatsu

(10) Patent No.: US 7,445,492 B2
(45) Date of Patent: Nov. 4, 2008

(54) CONNECTOR

(75) Inventor: Hiroyuki Hiramatsu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/824,854

(22) Filed: Jul. 2, 2007

(65) Prior Publication Data

US 2008/0009172 A1 Jan. 10, 2008

(30) Foreign Application Priority Data

Jul. 4, 2006 (JP) ..... 2006-184704

(51) Int. Cl.
*H01R 13/00* (2006.01)

(52) U.S. Cl. ..... 439/489

(58) Field of Classification Search ..... 439/489, 439/354, 357, 358

See application file for complete search history.

(56) References Cited

U.S. PATENT DOCUMENTS 4,640,566 A * 2/1987 Matsusaka ..... 439/350
4,915,643 A * 4/1990 Samejima et al. ..... 439/357
5,628,649 A * 5/1997 Yagi et al. ..... 439/489
5,785,546 A * 7/1998 Hamai et al. ..... 439/354
7,033,207 B2 4/2006 Nimura
7,306,472 B2 * 12/2007 Matsumoto et al. ..... 439/314

* cited by examiner

*Primary Examiner*—Phuong K Dinh
(74) *Attorney, Agent, or Firm*—Gerald E. Hespos; Anthony J. Casella

(57) ABSTRACT

A lock arm (15) is in the form of a cantilever and hitting portions (25) are arranged at positions closer to the free end of the lock arm (15) than a lock portion (20), a distance from a supporting point of the resilient deformation of the lock arm (15) (leg portion (17)) to the hitting portions (25) can be made longer as compared to a seesaw-shaped lock arm. This means that larger moment forces of the hitting portions (25) can be ensured when the lock arm (15) is resiliently deformed. Therefore, a large hitting sound can be produced when two connector housings (10, 30) are properly connected.

15 Claims, 6 Drawing Sheets

CONNECTOR

BACKGROUND OF THE INVENTION

1. Field of the Invention

The invention relates to a connector, to a connector assembly and to a connecting method therefor.

2. Description of the Related Art

U.S. Pat. No. 7,033,207 discloses a connector that produces a hitting sound when two housings are connected to confirm that a proper connection has been performed. One housing of the connector includes a lock arm capable of undergoing a seesaw-like resilient deformation. The other housing includes a locking projection. A lock at the front end of the lock arm moves onto the locking projection during the connecting operation and causes the lock arm to deform. A resilient force accumulates as the lock arm deforms and acts as a driving force for restoring the lock arm to an initial shape when the two housings are connected properly. The lock of the lock arm hits the other housing when the lock arm restores and produces a hitting sound.

The above-described lock arm is formed to undergo a seesaw-like resilient deformation. Thus, a supporting point of the resilient deformation is substantially in the longitudinal center of the lock arm. A distance from the supporting point of the resilient deformation of the lock arm to a hitting point becomes shorter to reduce a moment force at the hitting point when the lock arm is deformed. As a result, the hitting sound is small.

The invention was developed in view of the above situation and an object thereof is to produce a large hitting sound upon a connecting process.

SUMMARY OF THE INVENTION

The invention relates to a connector with a housing that is connectable with a mating connector housing. The housing includes a resilient lock arm that cantilevers substantially along a connecting direction of the housing with the mating housing. A lock is formed at a position on the lock arm closer to the cantilevered support than to a free end of the lock arm. At least one hitting portion is arranged at a position on the lock arm closer to the free end than the lock. The mating housing has an engaging portion that interferes with lock arm during a connecting operation and causes the lock arm to deform. The lock arm restores resiliently when the housing and the mating housing are connected properly. As a result, the lock engages the engaging portion to hold the housings in a properly connected state. The hitting portion hits at least one receiving portion as the lock arm is restored resiliently.

A distance from the support of the cantilevered lock arm to the hitting portion can be longer than with a seesaw-shaped lock arm. As a result, a large moment of force is applied to the hitting portion when the lock arm returns resiliently towards an undeformed condition, and a large hitting sound is produced when the housing connects properly with the mating housing.

The hitting portion preferably is displaced transversely from the lock. The offset transverse position of the hitting portion relative to the lock provides more design freedom for setting the position of the hitting portion and the lock in the longitudinal direction of the lock arm.

The lock arm could incline in the width direction, and hence a laterally disposed hitting portion might not contact the receiving portion. Accordingly, at least two hitting portions preferably are arranged at opposite transverse sides of the lock. Thus, at least one of the hitting portions is certain to contact the receiving portion even if the lock arm is inclined, and a hitting sound is produced reliably.

An operable portion preferably is formed near the free end of the lock arm and is wider than an area where the lock. The operable portion is used to deform the lock arm in a direction for separating the lock from the engaging portion. An unlocking operation for separating the lock from the engaging portion can be performed easily due to the wider size of the operable portion.

The hitting portion has a hitting surface for hitting the receiving portion. The hitting surface preferably is substantially flat and gradually widens towards the operable portion. Thus, the area of the hitting surface is increased by efficiently utilizing a dead space resulting from a width difference between the formation area of the lock and the operable portion. Accordingly, the sound volume of the hitting sound can be increased.

The hitting portion preferably has an inner hitting surface that is substantially parallel to the connecting direction of the housing with the mating housing. The hitting surface preferably has a substantially trapezoidal shape with oblique sides having different lengths.

The invention also relates to a connector assembly comprising the above-described connector and a mating connector having a mating housing that is connectable with the housing.

These and other features of the invention will become more apparent upon reading the following detailed description and accompanying drawings.

DETAILED DESCRIPTION OF THE PREFERRED EMBODIMENTS

Figure 1:
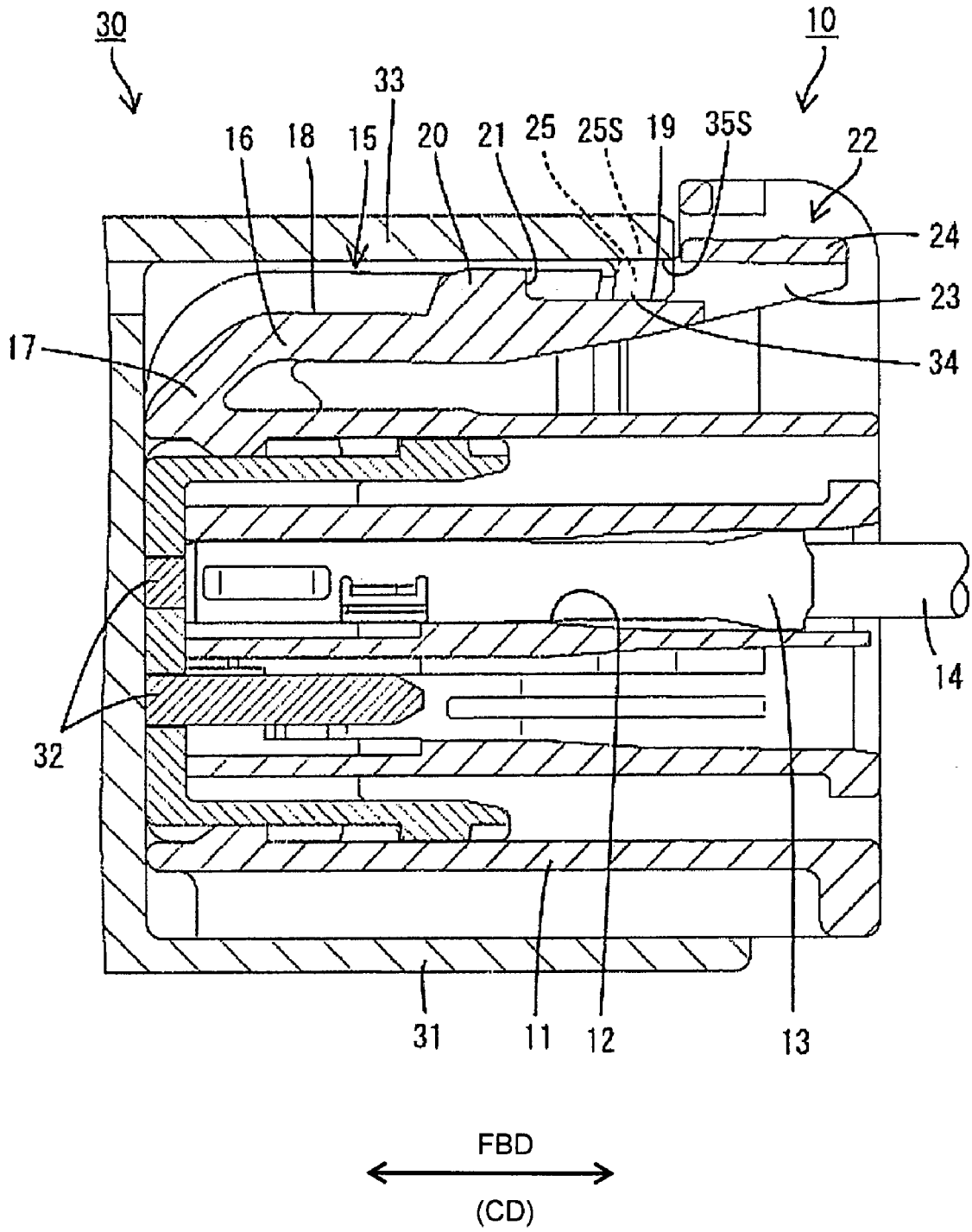
FIG. 1 is a section showing a state where two connector housings are properly connected in one embodiment.

A connector in accordance with the invention is described with reference to FIGS. 1 to 6. The connector has a female housing 10 and a male housing 30 that are connectable with each other. In the following description, ends of the female and male housings 10, 30 that are to be connected are referred to as the fronts concerning forward and backward directions FBD or connecting direction CD.

The female housing 10 has a main body 11 in the form of a vertically long block with cavities 12 for receiving female terminals 13 that are connected with wires 14. The wires 14 are drawn from rear end of the main body 11.

A lock arm 15 is formed unitarily on the upper surface of the main body 11 of the female housing 10. The lock arm 15 has a beam 16 and a leg 17. The leg 17 extends up from the upper surface of the main body 11 at a position near the front end of the female housing 10. The beam 16 is cantilevered backward from the upper part of the leg 17 and extends substantially parallel with the connecting direction CD of the two housings 10, 30. The beam 16 of the lock arm 15 is resiliently deformable up and down towards and away from the upper surface of the main body 11 and in directions substantially normal to the connecting direction CD of the two connector housings 10, 30. The leg 17 is the support for the resilient deformation of the beam 16. In a free state where the lock arm 15 is not deformed, the beam 16 is substantially parallel to the connecting direction CD of the two housings 10, 30 and to the upper surface of the main body 11.

A front groove 18 is formed substantially at a widthwise middle of the upper surface of the beam 16 and extends from the front end of the beam 16 to a longitudinal middle position. The front groove 18 has a substantially rectangular cross section. A rear groove 19 is formed substantially at the widthwise middle of the upper surface of the beam 16 and extends from a position slightly behind the front groove 18 to the rear end of the beam 16. The rear groove 19 also has a substantially rectangular cross section. A lock 20 is formed on the upper surface of the beam 16 between the front and rear grooves 18 and 19. A middle groove 21 is formed in a widthwise middle part of the lock 20. The middle groove 21 is open in the upper and rear surfaces of the lock portion 20 and communicates with the rear groove 19. The upper surface of the lock 20 is slightly higher than the upper surface of the beam 16.

An operable portion 22 extends back from the rear end of the beam 16 and at the free end of the lock arm 15. The operable portion 22 is substantially transversely symmetrical similar to the beam 16. Two supports 23 project up and away from the housing main body 11 at opposite left and right sides of the beam 16 and project farther back from the rear end of the beam 16. A finger placing plate 24 couples the upper end ends of the supports 23 and is substantially parallel to the beam 16.

Two substantially transversely symmetrical hitting portions 25 are defined on parts of the side walls of the lock arm 15 on opposite sides of the rear groove 19 and are substantially continuous with the front ends of the supports 23 of the operable portion 22. The hitting portions 25 are behind the lock 20 with respect to the longitudinal direction of the lock arm 15 and are at an end of the lock arm 15 opposite the leg 17. Additionally, the hitting portions 25 are displaced out relative to the lock 20 in a width direction WD that is substantially normal to the connecting direction CD. Hitting surfaces 25S are defined on the tops of the hitting portions 25. The hitting surfaces 25S are substantially flat and substantially parallel to the connecting direction CD of the two housings 10, 30. Additionally, the hitting surfaces 25S are slightly higher than the upper surface of the lock 20. The beam 16 has a substantially constant width from the leg 17 to a longitudinal middle position of the lock 20. However, the operable portion 22 is wider than the beam 16. The width of the beam 16 gradually increases from the longitudinal middle position of the lock 20 to the front end of the operable portion 22, and the hitting portions 25 are arranged in this gradually widened area. Accordingly, the hitting surfaces 25S of the hitting portions 25 are widened gradually from the front ends toward the rear ends. More particularly, the hitting surfaces 25S have substantially trapezoidal shapes with oblique sides having different lengths since the inner surfaces of the supports 23 are substantially continuous extensions of the inner surfaces of the hitting portions 25 and are aligned substantially parallel to the connecting direction of the two housings 10, 30.

The male housing 30 has a receptacle 31 with an open front end for receiving the female housing 10. Long narrow male terminals 32 are accommodated in the receptacle 31. An engaging portion 34 projects down and in from an upper wall 33 of the receptacle 31 at a position near the opening edge of the receptacle 31. Receiving portions 35 are defined on parts of the upper wall 33 at opposite left and right sides of the engaging portion 34. Substantially flat receiving surfaces 35S are defined in the receptacle 31 on lower parts of the receiving portions 35 and are aligned substantially parallel to the connecting direction CD of the housings 10, 30.

Figure 2:
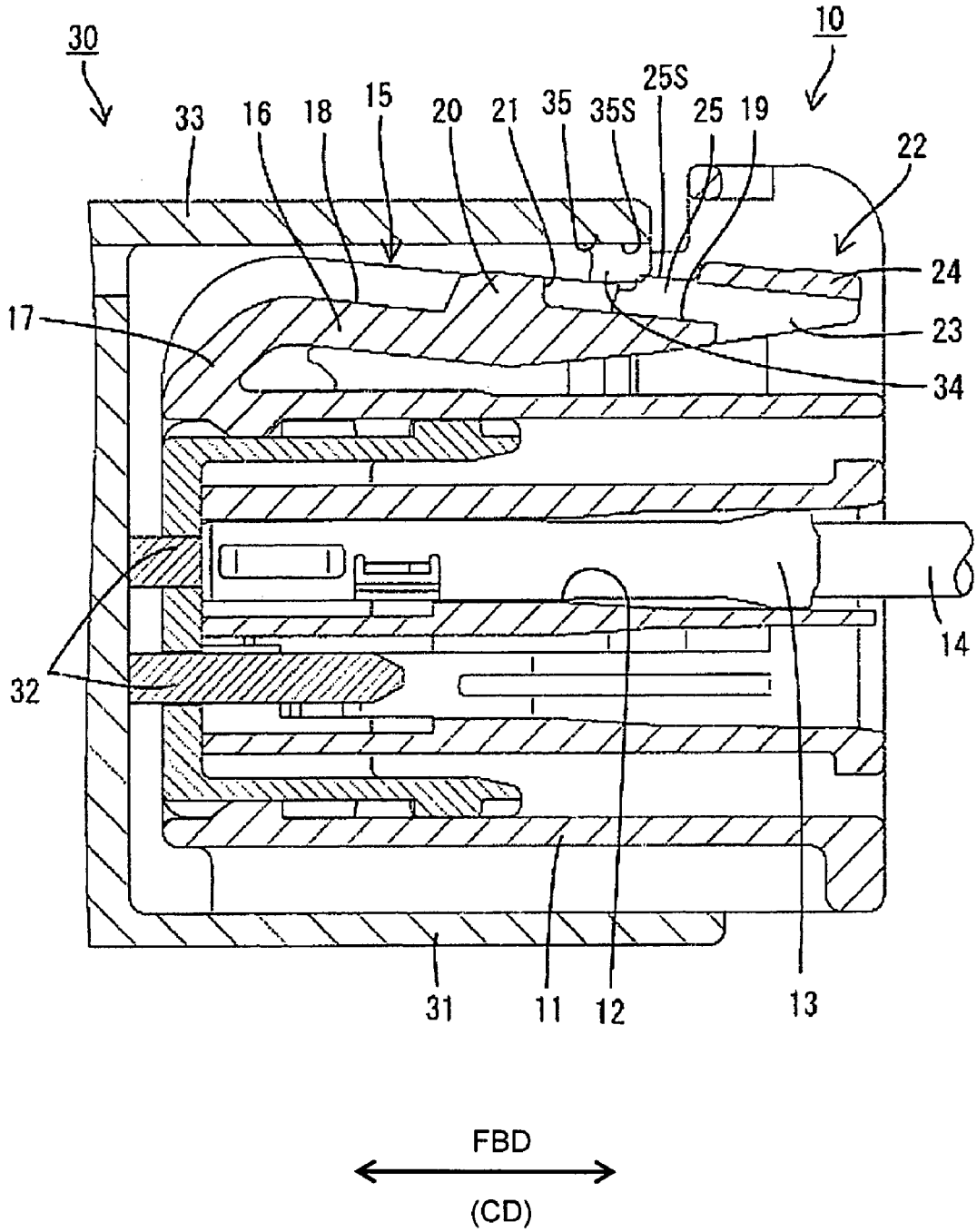
FIG. 2 is a section showing an intermediate state of the connecting operation of the two connector housings.
Figure 3:
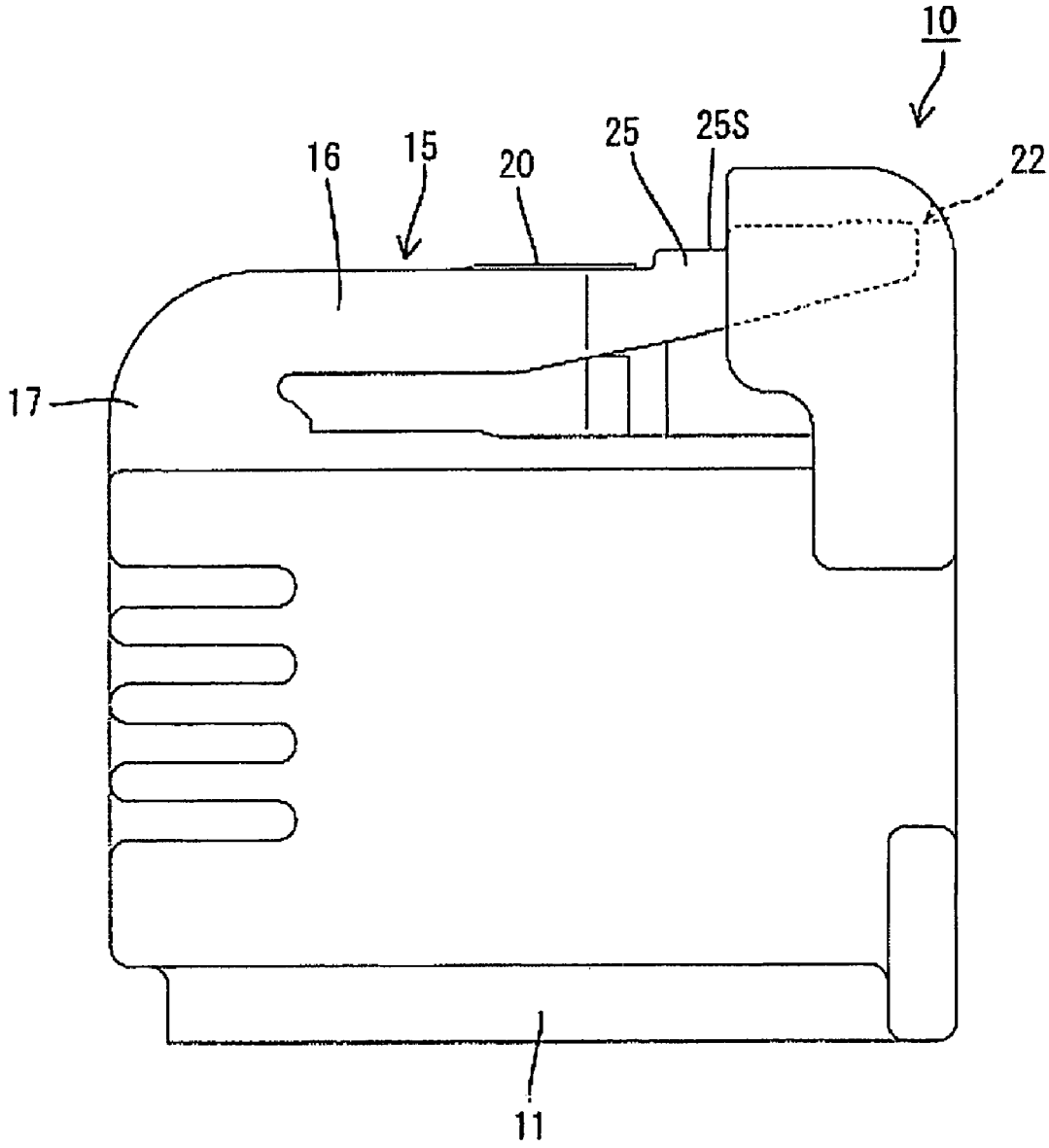
FIG. 3 is a side view of the female connector housing.
Figure 4:
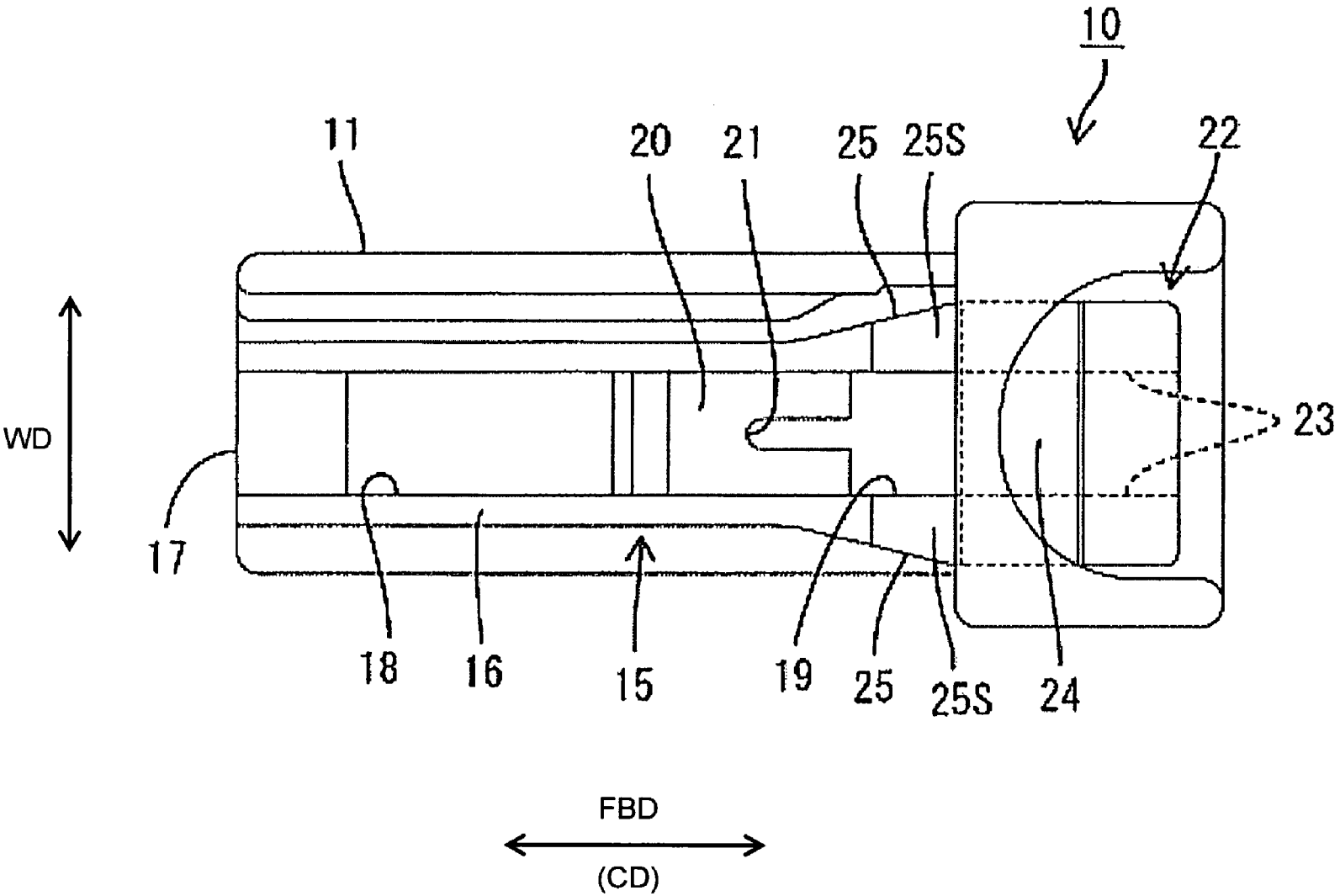
FIG. 4 is a plan view of the female connector housing.
Figure 5:
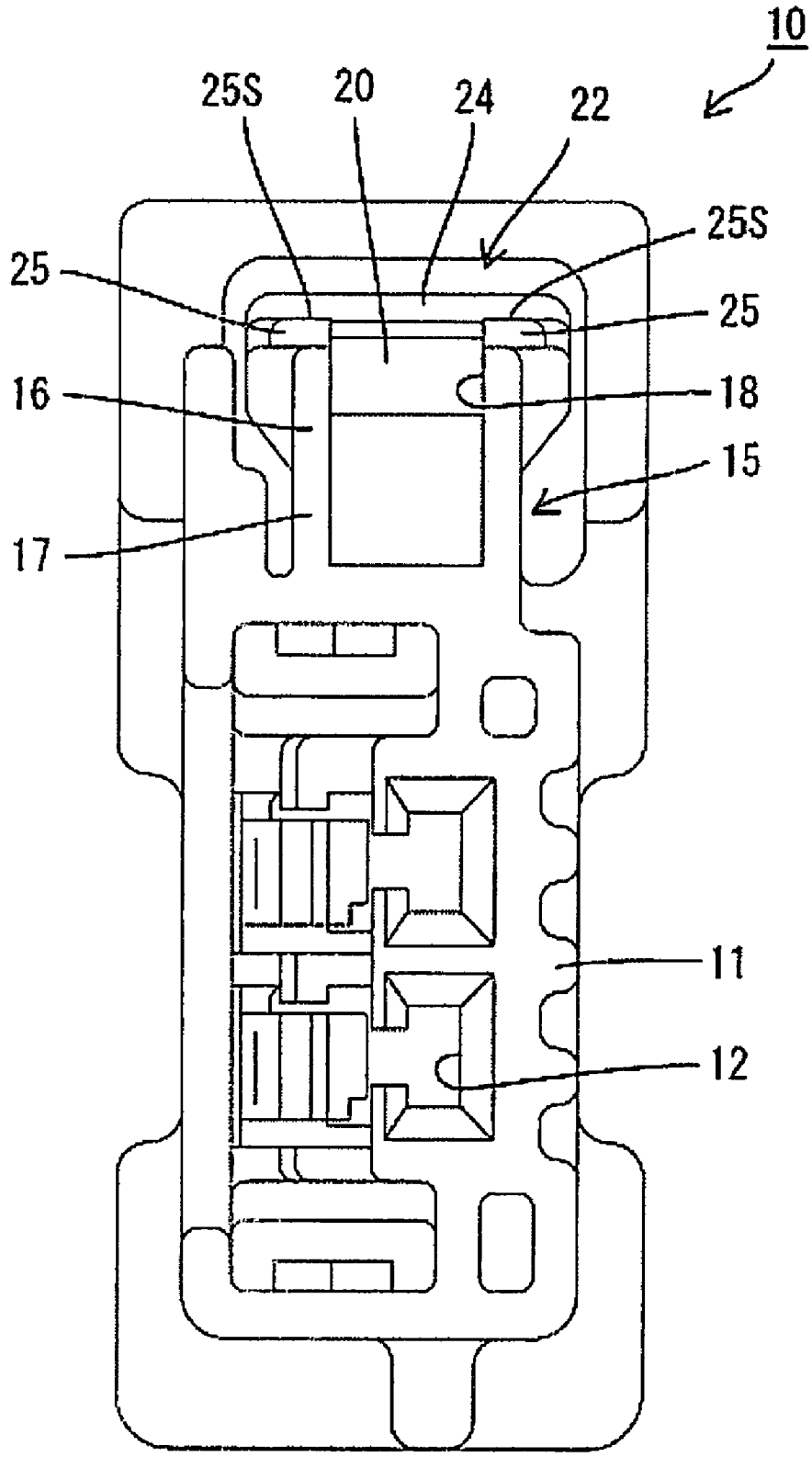
FIG. 5 is a front view of the female connector housing.
Figure 6:
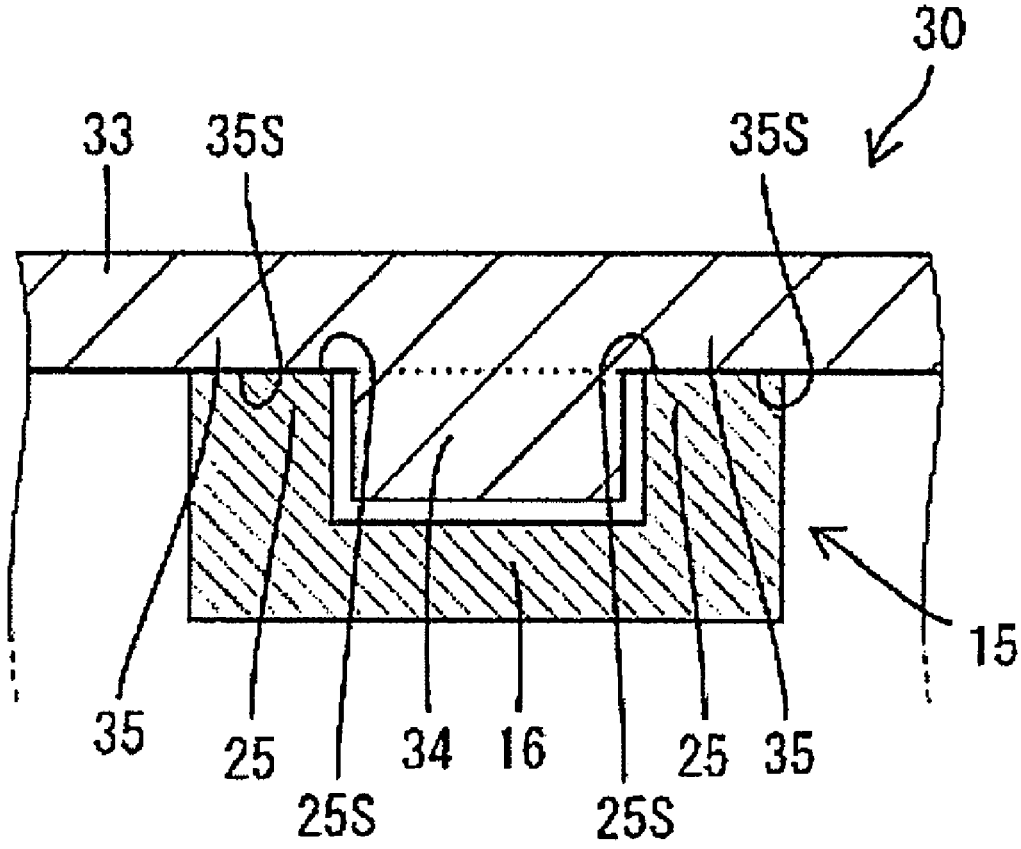
FIG. 6 is a partial enlarged section showing a contact state of hitting portions and receiving portions.

The lock 20 and the engaging portion 34 interfere with each other as the female housing 10 is fit into the receptacle 31. As a result, the lock arm 15 deforms down towards the housing 11, as shown in FIG. 2, and a resilient restoring force accumulates in the lock arm 15. At this time, the hitting portions 25 are at positions substantially corresponding to or below the receiving portions 35. The lock 20 passes the engaging portion 34 as the female housing 10 is fit sufficiently to reach a properly connected state of the two housings 10, 30. Therefore, the lock arm 15 is restored resiliently towards its original posture, and the two hitting portions 25 strike the two receiving portions 35 to produce a hitting sound. The substantially flat hitting surfaces 25S achieve surface contact with the similarly flat receiving surfaces 35S to produce a large collision sound. In the properly connected state, the lock 20 and the engaging portion 34 engaged to lock the two housings 10, 30 together.

The lock arm 15 is cantilevered along the connecting direction CD of the two housings 10, 30, and the lock 20 is at a position closer to the leg 17 that supports the resilient deformation than to the free end of the lock arm 15. The hitting portions 25, however, are closer to the free end than the lock 20. Thus, a distance from the support of the resilient deformation of the lock arm 15 to the hitting portions 25 is longer as compared to the case where the lock arm 15 is seesaw-shaped. Accordingly, large moment forces of the hitting portions 25 with a center on the support of the resilient deformation of the lock arm 15 (leg 17) can be ensured when the lock arm 15 is deformed. Therefore, a large hitting sound can be produced when the two housings 10, 30 are connected properly.

The hitting portions 25 are offset from the lock 20 in the width direction WD. Thus, a degree of freedom is higher upon setting the positions of the hitting portions 25 in the longitudinal direction of the lock arm 15.

The lock arm 15 could incline in the width direction WD. In this case, a transversely offset hitting portion 25 might not contact the receiving portion 35. However, the hitting portions 25 preferably are arranged at opposite sides of the lock 20 in the width direction WD. Thus, at least one of the hitting portions 25 is certain to contact the receiving portion 35 even if the lock arm 15 is inclined, and a hitting sound is produced reliably.

The operable portion 22 for deforming the lock arm 15 in a direction to separate the lock 20 from the engaging portion 34 is at the free end of the lock arm 15. The operable portion 22 is wider than the area where the lock 20 is formed. Accordingly, an unlocking operation can be performed easily.

The hitting portions 25 that hit the receiving portions 35 gradually widen towards the operable portion 22 to increase the areas of the hitting surfaces 25S and efficiently utilize dead spaces resulting from a width difference between the formation area of the lock 20 and the operable portion 22. In this way, the sound volume of the hitting sound is increased.

The invention is not limited to the above described and illustrated embodiment. For example, the following embodiments are also embraced by the technical scope of the present invention as defined by the claims.

One, three or more hitting portions may be provided.

The hitting portions may be asymmetric with respect to the width direction WD.

The shape of the hitting surfaces of the hitting portions is not limited to the trapezoidal shape with oblique sides having different lengths, but may substantially be the shape of an isosceles trapezoid, a rectangle other than trapezoids, a triangle or the like.

Although the engaging portion, the receiving portions and the hitting portions are arranged at the same position with respect to the longitudinal direction of the lock arm in the foregoing embodiment, the engaging portion may be arranged at a position displaced from the receiving portions and the hitting portions in the longitudinal direction according to the present invention.

What is claimed is:

1. A connector, comprising:

a housing connectable with a mating housing, the housing including a lock arm cantilevered substantially along a connecting direction of the housing with the mating housing, a lock formed at a position of the lock arm closer to a supporting point of the resilient deformation than a free end, and at least one hitting portion arranged at a position on the lock arm closer to the free end than the lock, and wherein the lock arm is interfered with and resilient deformed by an engaging portion of the mating housing during a connecting operation of the housing with the mating housing, wherein the lock is engaged with the engaging portion to hold the housing with the mating housing when the housing is connected properly with the mating housing and the lock arm is restored resiliently, wherein the at least one hitting portion can hit at least one receiving portion as the lock arm is restored resiliently, and wherein a hitting surface of the at least one hitting portion to hit the receiving portion is in the form of a substantially flat surface gradually widened towards the operable portion.

2. The connector of claim 1, wherein the hitting portion is arranged at the position displaced from the lock in a width direction.

3. The connector of claim 2, wherein at least one pair of hitting portions are arranged at substantially opposite sides of the lock in the width direction.

4. The connector of claim 1, wherein an operable portion to be operated to deform the lock in a direction separating the lock from the engaging portion is formed near the free end of the lock arm and is wider than an area where the lock is formed.

5. The connector of claim 1, wherein the inner surface of the hitting portion is substantially parallel to the connecting direction of the housing with the mating housing so that the hitting surface has a substantially trapezoidal shape with oblique sides having different lengths.

6. A connector, comprising a housing with a main body having opposite front and rear ends, a lock arm having a leg joined to the main body substantially adjacent the front end and a beam cantilevered from the leg towards the rear end of the main body a lock formed on a surface of the beam facing away from the main body and at a position along the beam spaced rearward from the leg and at least one hitting portion projecting from the surface of the beam facing away from the main body and at a position along the beam so that the lock is between the leg and the hitting portion, the hitting portion gradually widens at positions farther from the lock.

7. The connector of claim 6, wherein the hitting portion has a hitting surface facing away from the main body, the hitting surface being substantially planar.

8. The connector of claim 7, wherein the at least one hitting portion comprises first and second hitting portions offset laterally from one another.

9. The connector of claim 8, wherein the hitting portions are offset laterally from the lock.

10. The connector of claim 6, further comprising an operable portion at an end of the lock arm remote from the leg, the operable portion being wider than the beam.

11. A connector assembly, comprising:

a first housing;

a second housing connectable with the first housing;

a resiliently deformable lock arm formed on the first housing and cantilevered substantially along a connecting direction of the first and second housings, a lock formed on the lock arm closer to a support of resilient deformation than a free end, and at least one hitting portion at a position on the lock arm closer to the free end than the lock, the hitting portion gradually widening at positions farther from the lock;

an engaging portion formed on the second housing at a position for interfering with the lock during a connecting operation of the first housing with the second housing, the lock arm being restored resiliently when the housings are connected properly so that the lock engages the engaging portion to hold the first and second housings together; and at least one receiving portion formed on the second housing in a position to be engaged by the hitting portion the lock arm is restored resiliently to generate a hitting sound indicating complete connection.

12. The connector assembly of claim 11, wherein the hitting portion has a substantially planar hitting surface.

13. The connector assembly of claim 12, wherein the at least one hitting portion comprises first and second hitting portions offset laterally from one another.

14. The connector assembly of claim 13, wherein the hitting portions are offset laterally from the lock.

15. The connector assembly of claim 14, further comprising an operable portion at the free end of the lock arm.

* * * * *